United States Patent [19]

Christinat et al.

[11] Patent Number: 4,505,135

[45] Date of Patent: Mar. 19, 1985

[54] SAFETY DEVICE FOR A KNITTING MACHINE

[75] Inventors: Pierre L. Christinat, Roche; Louis Frund, Monthey, both of Switzerland

[73] Assignee: Atelier de construction Steiger S.A., Vionnaz, Switzerland

[21] Appl. No.: 501,883

[22] Filed: Jun. 7, 1983

[30] Foreign Application Priority Data

Jun. 11, 1982 [CH] Switzerland ..... 3634/82

[51] Int. Cl.[3] ..... D04B 35/10

[52] U.S. Cl. ..... 66/157; 66/163

[58] Field of Search ..... 66/157, 163, 165; 250/231 R, 232; 324/175

[56] References Cited

U.S. PATENT DOCUMENTS

| | | | |
|---|---|---|---|
| 3,719,061 | 3/1973 | Hadam et al. | 66/157 |
| 3,780,297 | 12/1973 | Gery | 250/231 R |
| 3,955,407 | 5/1976 | Rozett . | |
| 4,027,982 | 6/1977 | Ohishi | 66/157 |
| 4,037,157 | 7/1977 | Campbell | 250/231 R |

FOREIGN PATENT DOCUMENTS

| | | |
|---|---|---|
| 2005725 | 12/1969 | France . |
| 2190301 | 6/1973 | France . |
| 2051141 | 1/1981 | United Kingdom . |

*Primary Examiner*—Ronald Feldbaum

*Attorney, Agent, or Firm*—Birch, Stewart, Kolasch & Birch

[57] ABSTRACT

A safety device is provided for a knitting machine to ensure that the carriage stops in the case of sudden variation of the speed as a result of an impact or other occurrence such as tangling of the yarn into a ball. The device includes a metal strip formed with equidistant perforations assembled parallel to one of the needle bars of the knitting machine. A bridge integral with the carriage moves along this strip, and has on one side an emitter and on the other a transducer. When the carriage moves the succession of perforations gives rise to pulses of length inversely proportional to the translational speed of the carriage. A CPU processing unit processes the signal obtained after amplification and shaping of the pulses and delivers a STOP signal when a sudden disturbance is detected in the movement of the carriage.

7 Claims, 2 Drawing Figures

SAFETY DEVICE FOR A KNITTING MACHINE

This invention relates to a safety device for a flat knitting machine, the purpose of which safety device is to ensure that the carriage of the knitting machine stops whenever there is sudden variation in its speed as a result of an impact or ther incident, such as the tangling of the yarn into a ball.

When a disturbance occurs in a knitting machine during knitting, especially, but not exclusively when the yarn tangles into a ball, it is necessary to be able to stop the machine carriage quickly because, if the movement of the latter continues, considerable damage can be caused to the needle bar and to the needles. It has therefore been attempted to stop the carriage automatically in the case of impact. In particular, the provision of a piezoelectric transducer on the needle bar was considered, in order to detect the vibrations caused in the needle bar by an impact on the carriage. It was, however, found difficult to adjust such a detector so that it reacted exclusively to vibrations following a dangerous disturbance in the translational movement of the carriage.

Another solution consisted of measuring the torque necessary for driving the carriage by means of a spring. When the carriage came up against an abnormal resistance, the torque increased suddenly and such detection of torque increase was used to stop the carriage. However such detection is crude and does not make it possible to avoid damage with any certainty.

With a view to detecting defects in the needles, the needle bars or the collars, it has been proposed to assemble strain gauges on the cams of the carriage and to display the signal measured on the screen of an oscilloscope (see U.S. Pat. No. 3,955,407).

It has also been proposed to monitor the needles of a knitting machine, in order to detect damaged or missing needles, by means of a photoelectric sensing device which picks up the light reflected by the needles, and in which a curcuit for interpreting the signal responds to the time interval observed between successive pulses delivered by the sensing device and corresponding to needles present and intact (see French Patent Specification No. 2 005 725). This device does not detect braking of the carriage. It depends, moreover, on the surface quality of the needle heads.

The object of the present invention is to ensure a simple, rapid and sure detection, which is insensitive to disturbances other than the disturbances of the movement of the carriage.

According to the present invention, therefore, there is provided a safety device for a flat knitting machine for ensuring that the machine carriage stops in the event of sudden variation in its speed as a result of an impact or other incident, the safety device including means for generating pulses of a length inversely proportional to the speed of the carriage, means for continuously measuring the variation in length of the pulses, and means for stopping the carriage when this variation exceeds a predetermined reference rate.

In order to reduce the reaction time of the safety device to a minimum, not only is the variation between two successive pulses measured, but also the variation between the successive intervals between the pulses which follow one another.

An embodiment of the present invention will now be described, by way of example, with reference to the accompanying drawings, in which.

Figure 1:
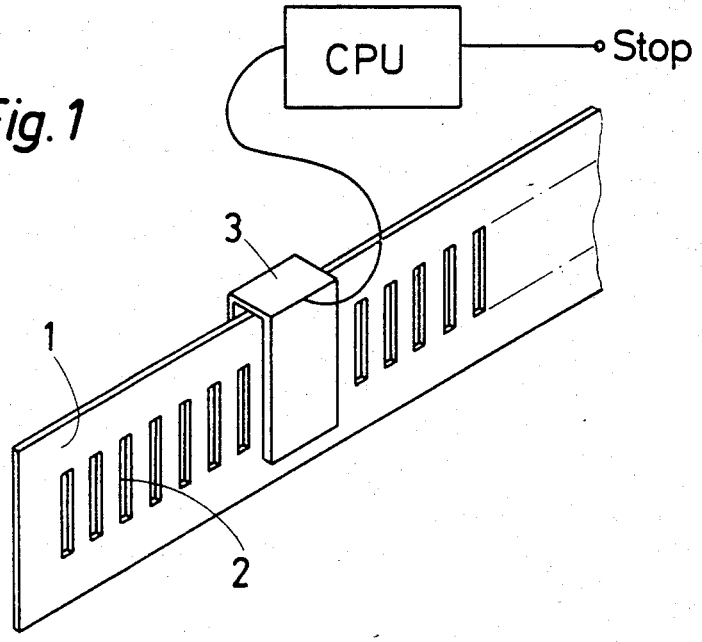
FIG. 1 is a diagrammatic view of the safety device for forming the pulses.
Figure 2:
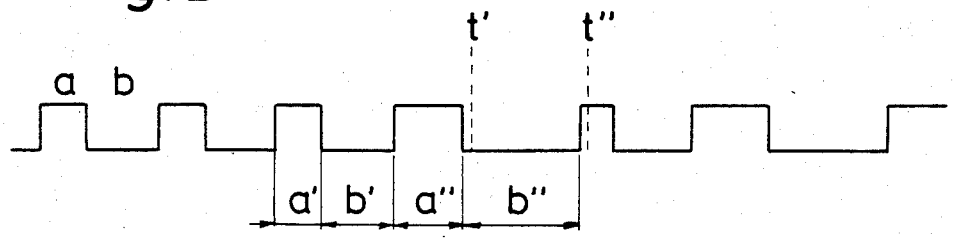
FIG. 2 is a diagram of a train of pulses disturbed by a sudden braking of the knitting machine carriage following an impact.

A metal strip 1 provided with equidistant perforations 2 is fitted on the knitting machine parallel to one of the needle bars of the knitting machine. This strip 1 consists advantageously of a strip which is already present on some machines for counting the needles, the spacing of the perforations 2 corresponding to the gauge of the needle bars. A bridge 3 integral with the carriage is movable along this strip 1 and has, on one side, an emitter, for example, an electroluminescent diode, and, on the other side, a transducer, for example, a photodiode or a phototransistor. This phototransistor can be assembled advantageously on a printed circuit which includes a first amplifier stage. When the machine carriage is moved, the succession of slots 2 gives rise to the appearance of pulses whose length is inversely proportional to the translational speed of the carriage. These pulses are amplified and formed in such a manner that approximately the series of rectangular pulses represented in FIG. 2 is obtained. The signal obtained is processed by a central processing unit (CPU), which delivers a "stop" signal when the analysis of this signal causes the recognition of a sudden disturbance in the movement of the carriage.

FIG. 2 shows the train of pulses generated by the detector 3 in a diagrammatic manner. Each perforation 2 generates a positive pulse a followed by an interval b which can also be considered as a negative pulse. By means of a suitable circuit, on the one hand, the rate of variation of the length of the positive pulse a is measured, and on the other hand, the rate of variation of the length of the negative pulses b is measured. The quotients $$(a'-a'')/a' \quad (b'-b'')/b'$$

are measured more accurately. The first quotient is measured at the instant t' immediately after the end of a positive pulse or on the appearance of a negative pulse, whilst the second quotient is measured after each negative pulse, that is on appearance of a positive pulse. It is of advantage if the length of the pulses is measured by sampling and numerical processing. The rate of variation is calculated and compared with the reference rate by means of a microprocessor.

If the carriage is sharply braked as a result of an impact, a pulse a suddenly appears with a duration a'' longer than the duration a' of the preceding pulse. Similarly, in general the interval b'' will be longer than the interval b'. It is possible, in the other hand, that the following positive pulse may be shorter than a normal pulse. This is why the absolute value of the difference is measured.

The carriage is stopped if the quotient $(a'-a'')/a'$ is greater than a limit value k determined experimentally, and similarly for the second quotient measured.

It would be possible to be content with comparing the positive pulses, but by also comparing the negative pulses, that is, the spaces, the sensitivity of the safety device is increased by reducing the reaction time in certain cases, in view of the fact that depending on the moment the impact takes place, it could very well happen that there was first of all a variation in the length of the intervals, that is, of the negative pulses, preceding a variation in the lengthof the positive pulses, contrary to what is shown in FIG. 2.

In view of the fact that the carriage does not always operate at the same speed, it may be advisable to subject the factor k to the speed of the carriage.

On the other hand, it is useful to take into account certain imperative requirements such as manual operation and the phase of reversing the direction of the carriage at the end of travel. It is possible to take this reversing into account by making the safety device operate only on a certain length of the needle bar.

In certain conditions, in particular when knitting ribs, it may be advisable to reduce the sensitivity of the device for certain rows of knitting, in order to avoid an unwanted stop. For this purpose the factor k is subjected to the knitting program. This program can be contained in the CPU processing unit.

What is claimed is:

1. A safety device for a flat knitting machine for ensuring that the machine carriage stops in the event of sudden variation in its speed as a result of an impact or other incident, the safety device including means for generating pulses of a length inversely proportional to the speed of the carriage, means for continuously measuring the variation in length of the pulses, and means for stopping the carriage when this variation exceeds a predetermined reference rate.

2. A device according to claim 1, in which the means for measuring the variation of the length of the pulses include electronic means for continuous measurement of the ratio between the difference in length of two successive pulses and the length of the first of these pulses.

3. A device according to claim 2, in which the means for measuring measure also the ratio between the difference in length of two successive intervals separating the pulses and the length of the first of these intervals.

4. A device according to claim 1, in which the means for generating said pulses include a perforated strip adapted to be fixed parallel to the needle bar of the machine, a light emitter integral with the carriage and which moves along one side to the perforated strip and an opto-electronic receiver integral with the carriage assembled facing the said emitter on the other side of the perforated strip.

5. A device according to claim 4 for use with a knitting machine provided with a perforated strip on the gauge of the needle bar for counting the needles, the perforated strip of the safety device comprising said perforated strip used for counting the needles.

6. A device according to claim 1, in which the reference rate is subject to the translational speed of the carriage.

7. A device according to claim 1, in which the reference rate is subject to the knitting program.

* * * * *